US010273659B2

(12) United States Patent
Kondo

(10) Patent No.: US 10,273,659 B2
(45) Date of Patent: Apr. 30, 2019

(54) HYDRAULIC DRIVE SYSTEM OF CONSTRUCTION MACHINE

(71) Applicant: KAWASAKI JUKOGYO KABUSHIKI KAISHA, Kobe-shi, Hyogo (JP)

(72) Inventor: Akihiro Kondo, Nishinomiya (JP)

(73) Assignee: KAWASAKI JUKOGYO KABUSHIKI KAISHA, Kobe (JP)

( * ) Notice: Subject to any disclaimer, the term of this patent is extended or adjusted under 35 U.S.C. 154(b) by 93 days.

(21) Appl. No.: 15/556,016

(22) PCT Filed: Mar. 7, 2016

(86) PCT No.: PCT/JP2016/001230

§ 371 (c)(1),
(2) Date: Sep. 6, 2017

(87) PCT Pub. No.: WO2016/147597

PCT Pub. Date: Sep. 22, 2016

(65) Prior Publication Data

US 2018/0058040 A1 Mar. 1, 2018

(30) Foreign Application Priority Data

Mar. 13, 2015 (JP) ..... 2015-050467

(51) Int. Cl.

| | |
|---|---|
| ***E02F 9/22*** | (2006.01) |
| ***F15B 11/00*** | (2006.01) |
| ***E02F 9/20*** | (2006.01) |
| ***F15B 13/04*** | (2006.01) |
| ***F15B 13/044*** | (2006.01) |

(52) U.S. Cl.

CPC ..... *E02F 9/2225* (2013.01); *E02F 9/2004* (2013.01); *E02F 9/2282* (2013.01); *E02F 9/2285* (2013.01); *F15B 11/00* (2013.01); *F15B 13/0401* (2013.01); *F15B 13/0442* (2013.01); *E02F 9/2292* (2013.01);

(Continued)

(58) Field of Classification Search

CPC ..... F15B 2211/45; F15B 2211/3116; E02F 9/2225; E02F 9/2204

USPC ..... 60/413

See application file for complete search history.

(56) References Cited

U.S. PATENT DOCUMENTS 7,168,246 B2 * 1/2007 Toji ..... E02F 9/2228 60/468

FOREIGN PATENT DOCUMENTS

JP 2005-265016 A 9/2005

* cited by examiner

*Primary Examiner* — F Daniel Lopez
*Assistant Examiner* — Daniel S Collins
(74) *Attorney, Agent, or Firm* — Oliff PLC

(57) ABSTRACT

A hydraulic drive system of a construction machine includes: a control valve configured such that an opening area of a center bypass passage gradually decreases in accordance with increase in an operation signal; an operation device that outputs the operation signal; a bleed-off line; and a bleed-off valve that includes a pilot port to which a secondary pressure from a solenoid proportional valve is led, the bleed-off valve being configured such that: a bypass passage is open until the operation signal exceeds a first setting value, and the bypass passage is closed when the operation signal exceeds the first setting value; and an unloading passage is opened when the operation signal exceeds a second setting value, and an opening area of the unloading passage gradually decreases until the operation signal that has exceeded the second setting value reaches a third setting value.

3 Claims, 6 Drawing Sheets

(52) U.S. Cl.
CPC ..... *E02F 9/2296* (2013.01); *F15B 2211/3116* (2013.01); *F15B 2211/45* (2013.01)

HYDRAULIC DRIVE SYSTEM OF CONSTRUCTION MACHINE

TECHNICAL FIELD

The present invention relates to a hydraulic drive system of a construction machine.

BACKGROUND ART

Construction machines, such as hydraulic excavators and hydraulic cranes, perform various work by means of a hydraulic drive system. For example, Patent Literature 1 discloses a hydraulic drive system 100 as shown in FIG. 5.

In the hydraulic drive system 100, a plurality of control valves 130 are disposed on a circulation line 120 extending from a pump 110 to a tank. Each control valve 130 is connected to a pilot operation valve 140 (operation device) including an operating lever, and controls the supply and discharge of hydraulic oil to and from an actuator 150 in accordance with an operating amount of the operating lever. The hydraulic drive system 100 adopts a configuration in which, when any of the pilot operation valves 140 is operated, the hydraulic oil discharged from the pump 110 is released to the tank without passing through the control valves 130.

Specifically, the hydraulic drive system 100 includes a bleed-off line 160, which branches off from the circulation line 120 at a position upstream of the control valves 130 and which extends to the tank. A bleed-off valve 170 including a pilot port is disposed on the bleed-off line 160, and a secondary pressure from a solenoid proportional valve 180 is led to the pilot port of the bleed-off valve 170.

The bleed-off valve 170 includes an unloading passage forming a part of the bleed-off line 160. As shown in FIG. 6, the bleed-off valve 170 is configured such that the unloading passage is opened when the operating amount of any of the operating levers exceeds a first setting value θ1, and the opening area of the unloading passage gradually decreases as the operating amount of the operating lever increases from the first setting value θ1.

On the other hand, each control valve 130 includes a center bypass passage forming a part of the circulation line 120. Each control valve 130 is configured such that the center bypass passage is open until the operating amount of the corresponding operating lever exceeds a second setting value θ2, which is slightly greater than the first setting value θ1, and the center bypass passage is rapidly closed when the operating amount of the operating lever exceeds the second setting value θ2. By blocking the circulation line 120 by the control valve 3 in this manner, the hydraulic oil discharged from the pump 110 can be released to the tank through the bleed-off line 160.

CITATION LIST

Patent Literature

PTL 1: Japanese Laid-Open Patent Application Publication No. 2005-265016

SUMMARY OF INVENTION

Technical Problem

However, in a case, for example, where the solenoid proportional valve 180 has failed or an electrical path is cut off in the hydraulic drive system 100 shown in FIG. 5 (hereinafter, "at the time of failure"), the state of the bleed-off line 160 being blocked by the bleed-off valve 170 is kept. In this case, when any of the operating levers is operated, if the operating amount of the operating lever exceeds the second setting value θ2, the corresponding control valve 130 suddenly blocks the circulation line 120. As a result, the amount of hydraulic oil supplied to the corresponding actuator 150 increases rapidly. This causes a shock to the actuator 150.

In view of the above, an object of the present invention is to provide a hydraulic system of a construction machine, the hydraulic system being capable of: when an operation device is operated, releasing hydraulic oil discharged from a pump to a tank without passing the hydraulic oil through a control valve; and allowing an actuator to move smoothly even at the time of failure.

Solution to Problem

In order to solve the above-described problems, a hydraulic drive system of a construction machine according to the present invention includes: a circulation line extending from a pump to a tank; a control valve disposed on the circulation line and controlling supply and discharge of hydraulic oil to and from an actuator; an operation device that receives an operation for moving the actuator and that outputs an operation signal corresponding to an amount of the operation; a bleed-off line that branches off from the circulation line at a position upstream of the control valve and that extends to the tank; a solenoid proportional valve that outputs a secondary pressure indicating a positive correlation with the operation signal; and a bleed-off valve that includes a pilot port to which the secondary pressure from the solenoid proportional valve is led, a bypass passage forming a part of the circulation line, and an unloading passage forming a part of the bleed-off line, the bleed-off valve being configured such that: the bypass passage is open until the operation signal exceeds a first setting value, and the bypass passage is closed when the operation signal exceeds the first setting value; and the unloading passage is opened when the operation signal exceeds a second setting value that is not greater than the first setting value, and an opening area of the unloading passage gradually decreases until the operation signal that has exceeded the second setting value reaches a third setting value. The control valve is configured such that an opening area of a center bypass passage forming a part of the circulation line gradually decreases in accordance with increase in the operation signal.

According to the above configuration, when the operation device is operated, the bleed-off valve blocks the circulation line and opens the bleed-off line. This makes it possible to release the hydraulic oil discharged from the pump to the tank without passing the hydraulic oil through the control valve. On the other hand, at the time of failure, the state of the bleed-off line being blocked by the bleed-off valve is kept, but the bypass passage of the bleed-off valve is opened, and the opening area of the center bypass passage of the control valve gradually decreases in accordance with increase in the operation signal outputted from the operation device. This makes it possible to smoothly move the actuator even at the time of failure.

The bleed-off valve may be a single valve. According to this configuration, the structure is more simplified than in a case where the bleed-off valve is constituted by two switching valves, and thereby the cost can be reduced.

Alternatively, the bleed-off valve may include: a first switching valve disposed on the circulation line; and a second switching valve disposed on the bleed-off line.

Advantageous Effects of Invention

The present invention makes it possible to: when the operation device is operated, release the hydraulic oil discharged from the pump to the tank without passing the hydraulic oil through the control valve; and allow the actuator to move smoothly even at the time of failure.

DESCRIPTION OF EMBODIMENTS

Figure 1:
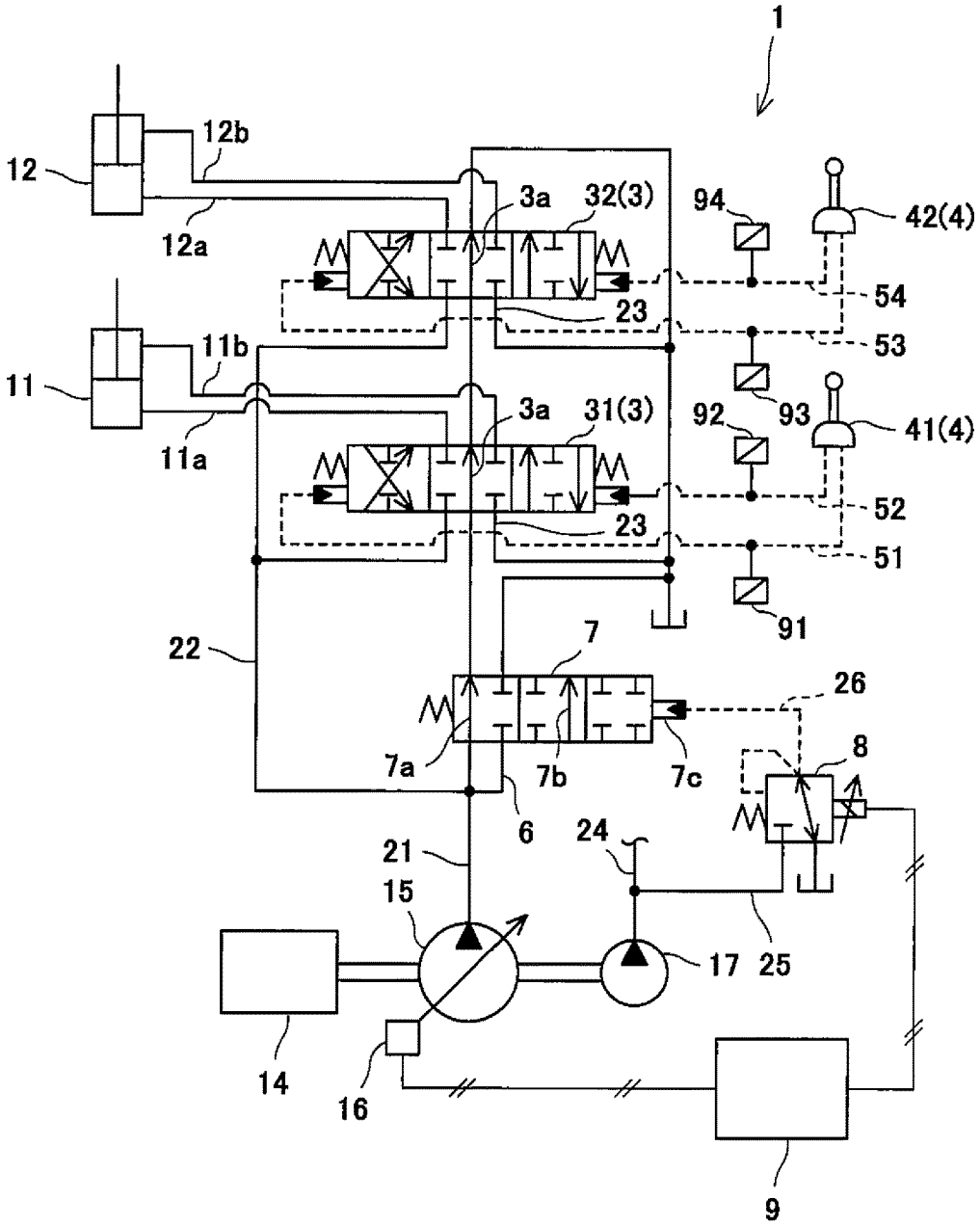
FIG. 1 shows a schematic configuration f a hydraulic drive system according to one embodiment of the present invention.
Figure 2:
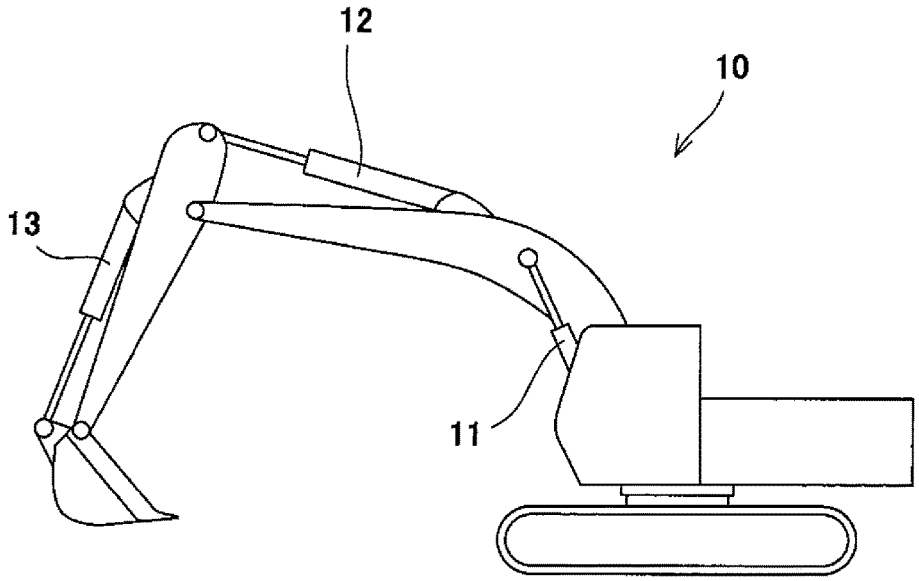
FIG. 2 is a side view of a hydraulic excavator that is one example of a construction machine.

FIG. 1 shows a hydraulic drive system 1 of a construction machine according to one embodiment of the present invention. FIG. 2 shows a construction machine 10, in which the hydraulic drive system 1 is installed. Although the construction machine 10 shown in FIG. 2 is a hydraulic excavator, the present invention is applicable to other construction machines, such as a hydraulic crane.

The hydraulic drive system 1 includes, as hydraulic actuators, a boom cylinder 11, an arm cylinder 12, and a bucket cylinder 13, which are shown in FIG. 2, and also a turning motor and a pair of right and left running motors, which are not shown. The hydraulic drive system 1 further includes: a main pump 15 for supplying hydraulic oil to these actuator s; and an engine 14 driving the main pump 15. It should be noted that, in FIG. 1, the actuators other than the boom cylinder 11 and the arm cylinder 12 are not shown for the purpose of simplifying the drawing.

A circulation line 21 extends from the main pump 15 to a tank. A plurality of control valves 3 including a boom control valve 31 and an arm control valve 32 (the control valves other than the boom control valve 31 and the arm control valve 32 are not shown) are disposed on the circulation line 21. A parallel line 22 branches off from the circulation line 21. The hydraulic oil discharged from the main pump 15 is led to all the control valves 3 on the circulation line 21 through the parallel line 22. Tank lines 23 are connected to the respective control valves 3 on the circulation line 21.

The boom control valve 31 is connected to the boom cylinder 11 by a pair of supply/discharge lines 11*a* and 11*b*. The boom control valve 31 controls the supply and discharge of the hydraulic oil to and from the boom cylinder 11. Similarly, the arm control valve 32 is connected to the arm cylinder 12 by a pair of supply/discharge lines 12*a* and 12*b*. The arm control valve 32 controls the supply and discharge of the hydraulic oil to and from the arm cylinder 12. The other control valves 3, which are not shown, also control the supply and discharge of the hydraulic oil to and from respective actuators.

The hydraulic drive system 1 further includes a plurality of operation devices 4, each of which receives an operation for moving a corresponding one of the above-described actuators. Each operation device 4 outputs an operation signal corresponding to the amount of the received operation. In the present embodiment, a pilot operation valve that includes an operating lever and that outputs a pilot pressure whose magnitude corresponds to an operating amount (inclination angle) of the operating lever is used as each operation device 4.

For example, the operation devices 4 include: a boom operation valve 41 connected to pilot ports of the boom control valve 31 by a pair of pilot lines 51 and 52; and an arm operation valve 42 connected to pilot ports of the arm control valve 32 by a pair of pilot lines 53 and 54. In this manner, each operation device 4 is connected to the pilot ports of the corresponding control valve 3 by a pair of pilot lines.

Each operation device 4 is supplied with the hydraulic oil from an auxiliary pump 17 through a supply line 24. The auxiliary pump 17 is driven by the engine 14.

It should be noted that, each operation device 4 may be an electrical joystick that outputs the operating amount (inclination angle) of the operating lever as an electrical operation signal. In this case, the pair of pilot ports of each control valve 3 is connected to a pair of solenoid proportional valves, and these solenoid proportional valves are controlled by a controller 9 based on the operation signal outputted from the corresponding operation device 4. The controller 9 will be described below.

The above-described main pump 15 is a variable displacement pump (a swash plate pump or bent axis pump) whose tilting angle can be changed. The tilting angle of the main pump 15 is changed by a regulator 16. In the present embodiment, the discharge flow rate of the main pump 15 is controlled by positive control in accordance with the operation signal outputted from each operation device 4. However, as an alternative, the discharge flow rate of the main pump 15 may be controlled by load-sensing control.

Specifically, each pilot line is provided with a pressure meter that measures a pilot pressure (an operation signal) outputted from the corresponding operation device 4. Among these pressure meters, four pressure meters 91 to 94 are shown in FIG. 1. The regulator 16 and all the pressure meters are connected to the controller 9. It should be noted that FIG. 1 shows only part of control lines for simplifying the drawing.

The regulator 16 is controlled by the controller 9 based on pilot pressures measured by the above pressure meters. For example, the regulator 16 includes: a hydraulic device that adjusts the tilting angle of the main pump 15; and a solenoid proportional valve that outputs a secondary pressure to the hydraulic device. The controller 9 controls the regulator 16 such that while none of the operation devices 4 is outputting a pilot pressure, the tilting angle of the main pump 15 is kept to a minimum, and when any of the operation devices 4 outputs a pilot pressure, the tilting angle of the main pump 15 increases in accordance with the pilot pressure.

The present embodiment adopts a configuration in which, when any of the operation devices 4 is operated, the hydraulic oil discharged from the main pump 15 is released to the tank without passing through the control valves 3. Specifically, the hydraulic drive system 1 includes a bleed-off line 6, which branches off from the circulation line 21 at a position upstream of the control valves 3 and which extends to the tank. In the present embodiment, a single bleed-off valve 7 is disposed on the circulation line 21 and the bleed-off line 6.

The bleed-off valve 7 includes: a bypass passage 7*a* forming a part of the circulation line 21; and an unloading passage 7*b* forming a part of the bleed-off line 6. The bleed-off valve 7 shifts among a first position, a second position, and a third position. When the bleed-off valve 7 is in the first position (left-side position in FIG. 1), the bypass passage 7*a* is open and the unloading passage 7*b* is closed. When the bleed-off valve 7 is in the second position (central position in FIG. 1), the bypass passage 7*a* is closed and the unloading passage 7*b* is open. When the bleed-off valve 7 is in the third position (right-side position in FIG. 1), the bypass passage 7*a* and the unloading passage 7*b* are closed. The first position is also the neutral position. The bleed-off valve 7 further includes a pilot port 7*c* for shifting the bleed-off valve 7 from the first position to the third position through the second position.

The pilot port 7*c* is connected to a solenoid proportional valve 8 by a pilot line 26. That is, a secondary pressure outputted from the solenoid proportional valve 8 is led to the pilot port 7*c*. The solenoid proportional valve 8 is connected to the auxiliary pump 17 by a primary pressure line 25.

The solenoid proportional valve 8 is a direct proportional valve that outputs a secondary pressure proportional to a command current. The solenoid proportional valve 8 is fed with the command current from the controller 9, the command current being proportional to the operation signal outputted from each operation device 4. That is, the secondary pressure outputted from the solenoid proportional valve 8 indicates a positive correlation with the operation signal.

Figure 3:
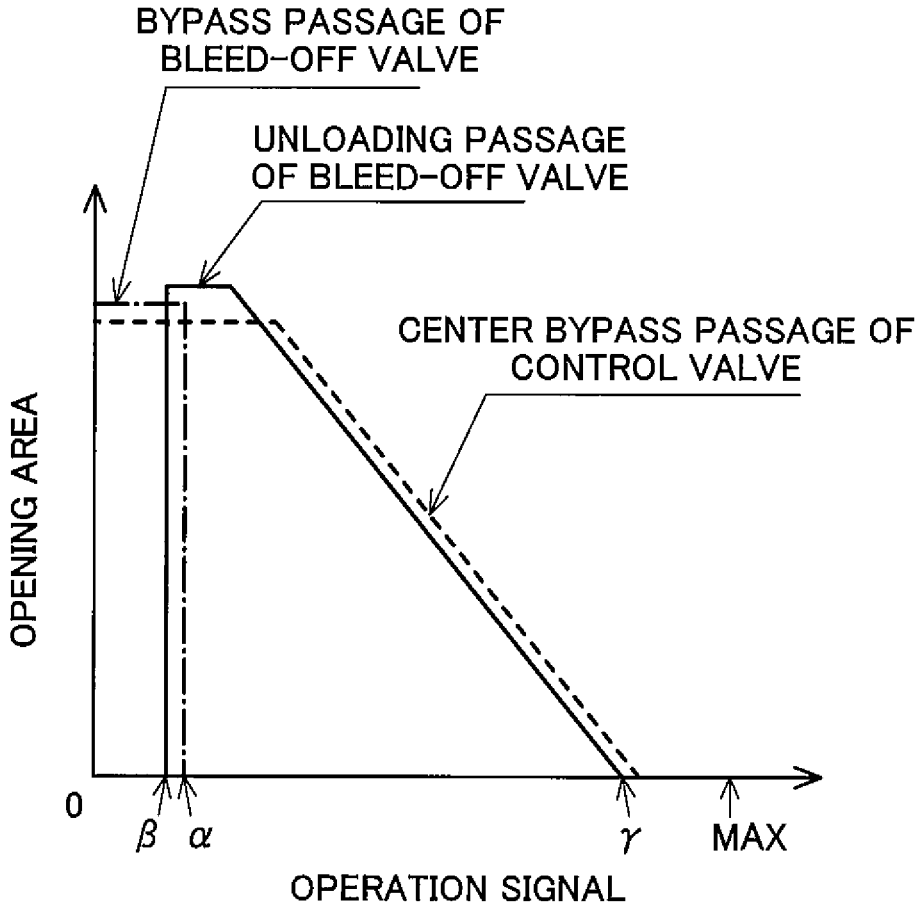
FIG. 3 is a graph showing a relationship between an operation signal outputted from an operation device and opening areas of three passages (a center bypass passage of a control valve, a bypass passage of a bleed-off valve, and an unloading passage of the bleed-off valve).

As shown in FIG. 3, the bleed-off valve 7 is configured such that the bypass passage 7*a* is open until the operation signal exceeds a first setting value α, and the bypass passage 7*a* is closed when the operation signal exceeds the first setting value α. The bleed-off valve 7 is further configured such that the unloading passage 7*b* is opened when the operation signal exceeds a second setting value β, which is not greater than the first setting value α, and the opening area of the unloading passage 7*b* gradually decreases until the operation signal that has exceeded the second setting value β reaches a third setting value γ. In the present embodiment, the opening area of the unloading passage 7*b* is kept to a maximum when the operation signal is in a range close to the second setting value β.

In FIG. 3, the maximum opening area of the unloading passage 7*b* is greater than the maximum opening area of the bypass passage 7*a*. However, as an alternative, the maximum opening area of the unloading passage 7*b* may be less than the maximum opening area of the bypass passage 7*a*.

In the present embodiment, the second setting value β is less than the first setting value α. Accordingly, if the bleed-off valve 7 is illustrated with precise symbols, there is a position between the first and second positions, and when the bleed-off valve 7 is in the position, both the bypass passage 7*a* and the unloading passage 7*b* are open. (In FIG. 1, the position is not shown for the sake of simplifying the drawing.) To be precise, the bleed-off valve 7 is in the first position until the operation signal exceeds the second setting value β, and after the operation signal has exceeded the first setting value α, the bleed-off valve 7 is in the second position until the operation signal reaches the third setting value γ. It should be noted that the second setting value β may be equal to the first setting value α. After the operation signal has exceeded the third setting value γ, the bleed-off valve 7 is in the third position until the operation signal reaches a maximum value.

Meanwhile, each of the above-described control valves 3 includes a center bypass passage 3*a* forming a part of the circulation line 21 as shown in FIG. 1. As Shown in FIG. 3, each control valve 3 is configured such that the opening area of the center bypass passage 3*a* gradually decreases in accordance with increase in the operation signal.

The opening area of the center bypass passage 3*a* corresponding to the operation signal is substantially equal to the opening area of the unloading passage 7*b* corresponding to the same operation signal. The term "substantially equal" means that the opening area of the center bypass passage 3*a* is in the range of ±10% of the opening area of the unloading passage 7*b*. In the present embodiment, the opening area of the center bypass passage 3*a* is set such that, while the opening area of the center bypass passage 3*a* is decreasing, the opening area of the center bypass passage 3*a* is slightly greater than the opening area of the unloading passage 7*b* of the bleed-off valve 7. Further, in the present embodiment, the opening area of the unloading passage 7*b* of the bleed-off valve 7 and the opening area of the center bypass passage 3*a* of each control valve 3 decrease in a linear manner. However, as an alternative, these opening areas may decrease in a curvilinear manner.

As described above, in the hydraulic drive system 1 according to the present embodiment, when any of the operation devices 4 is operated, the bleed-off valve 7 blocks the circulation line 21 and opens the bleed-off line 6. This makes it possible to release the hydraulic oil discharged from the main pump 15 to the tank without passing the hydraulic oil through the control valves 3. On the other hand, at the time of failure, the state of the bleed-off line 6 being blocked by the bleed-off valve 7 is kept, but the bypass passage 7*a* of the bleed-off valve 7 is opened, and the opening area of the center bypass passage 3*a* of each control valve 3 gradually decreases in accordance with increase in the operation signal outputted from the corresponding operation device 4. This makes it possible to smoothly move the actuators (such as the boom cylinder 11 and the arm cylinder 12) even at the time of failure.

(Variations)

The present invention is not limited to the above-described embodiment. Various modifications can be made without departing from the spirit of the present invention.

Figure 4:
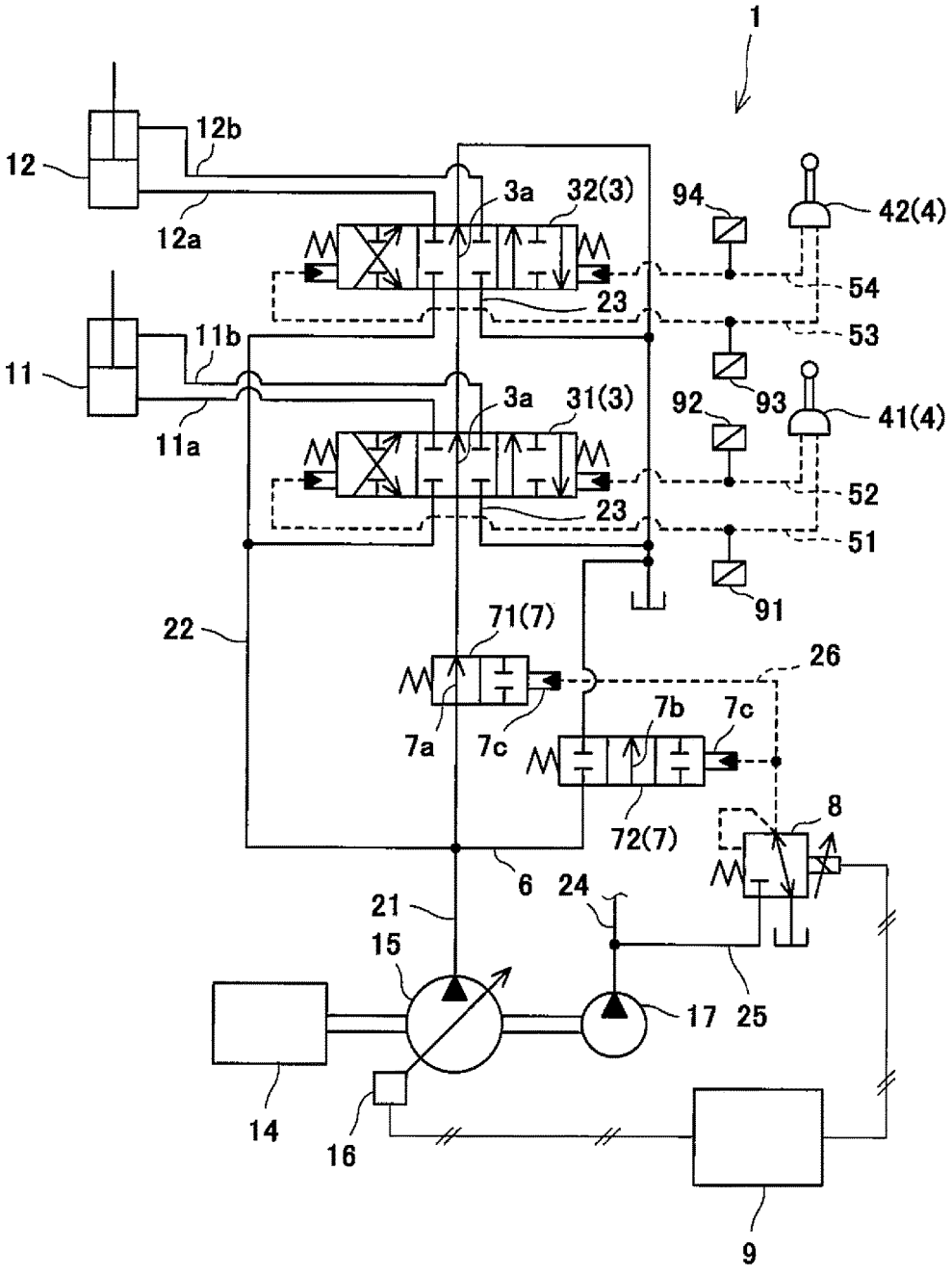
FIG. 4 shows a schematic configuration of a hydraulic drive system according to one variation.
Figure 5:
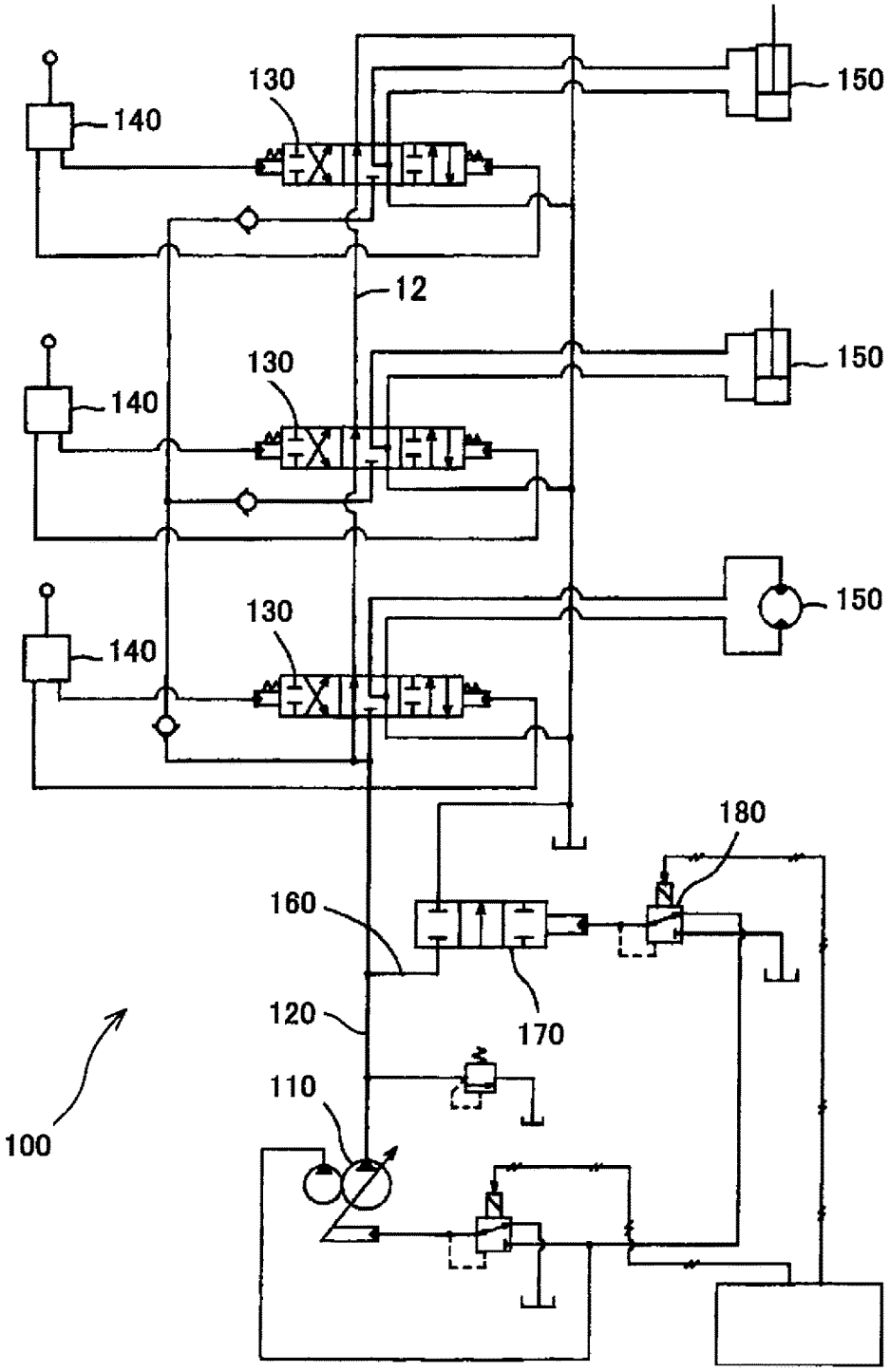
FIG. 5 shows a schematic configuration of a conventional hydraulic drive system.
Figure 6:
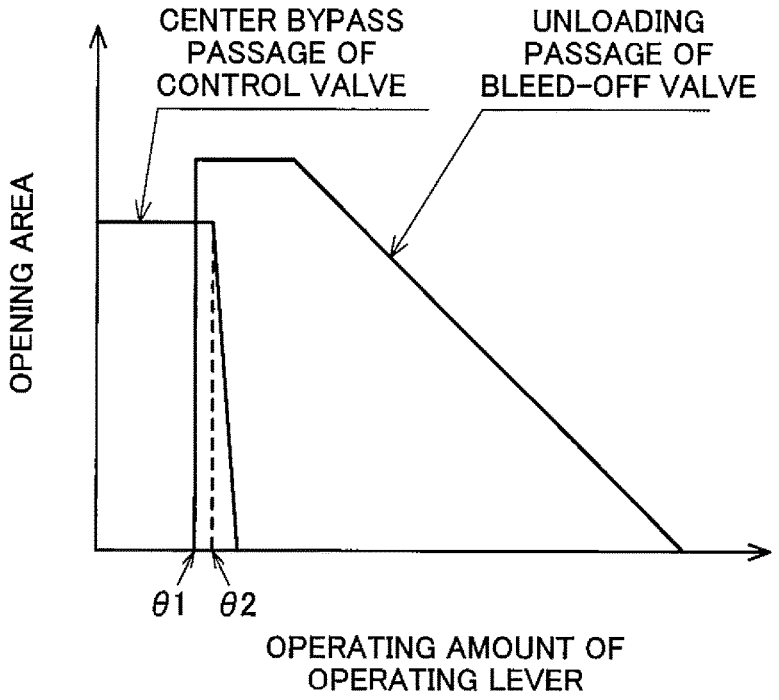
FIG. 6 is a graph showing a relationship between an operating amount of an operating lever and opening areas of two passages (a center bypass passage of a control valve and an unloading passage of a bleed-off valve) in the conventional hydraulic drive system.

For example, as shown in FIG. 4, the bleed-off valve 7 may be constituted by a first switching valve 71 disposed on the circulation line 21 and a second switching valve 72 disposed on the bleed-off line 6. However, if the bleed-off valve 7 is a single valve as in the above-described embodiment, the structure is more simplified than in a case where the bleed-off valve 7 is constituted by the two switching valves 71 and 72, and thereby the cost can be reduced. It should be noted that in the case where the bleed-off valve 7 is constituted by the two switching valves 71 and 72, the first switching valve 71 may be disposed downstream of the control valves 3.

REFERENCE SIGNS LIST

1 hydraulic drive system
11 boom cylinder (actuator)

12 arm cylinder (actuator)
15 main pump
21 circulation line
3 control valve
3*a* center bypass passage
31 boom control valve
32 arm control valve
4 operation device
41 boom operation valve (operation device
42 arm operation valve (operation device)
6 bleed-off line
7 bleed-off valve
7*a* bypass passage
7*b* unloading passage
71 first switching valve
72 second switching valve
8 solenoid proportional valve

The invention claimed is:

1. A hydraulic drive system of a construction machine, the hydraulic drive system comprising:

a circulation line extending from a pump to a tank;

a control valve disposed on the circulation line and controlling supply and discharge of hydraulic oil to and from an actuator;

an operation device that receives an operation for moving the actuator and that outputs an operation signal corresponding to an amount of the operation;

a bleed-off line that branches off from the circulation line at a position upstream of the control valve and that extends to the tank;

a solenoid proportional valve that outputs a secondary pressure indicating a positive correlation with the operation signal; and a bleed-off valve that includes a pilot port to which the secondary pressure from the solenoid proportional valve is led, a bypass passage forming a part of the circulation line, and an unloading passage forming a part of the bleed-off line, the bleed-off valve being configured such that:

the bypass passage is open until the operation signal exceeds a first setting value, and the bypass passage is closed when the operation signal exceeds the first setting value; and the unloading passage is opened when the operation signal exceeds a second setting value that is not greater than the first setting value, and an opening area of the unloading passage gradually decreases until the operation signal that has exceeded the second setting value reaches a third setting value, wherein the control valve is configured such that an opening area of a center bypass passage forming a part of the circulation line gradually decreases in accordance with increase in the operation signal.

2. The hydraulic drive system of a construction machine according to claim 1, wherein the bleed-off valve is a single valve.

3. The hydraulic drive system of a construction machine according to claim 1, wherein the bleed-off valve includes:

a first switching valve disposed on the circulation line; and a second switching valve disposed on the bleed-off line.

* * * * *